US006684751B2

(12) United States Patent
Kapiloff et al.

(10) Patent No.: US 6,684,751 B2
(45) Date of Patent: Feb. 3, 2004

(54) ROLLED WEB DISPENSER AND CUTTING APPARATUS

(75) Inventors: David Wayne Kapiloff, Gainesville, GA (US); Richard Paul Lewis, Marietta, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 55 days.

(21) Appl. No.: 10/015,629

(22) Filed: Dec. 13, 2001

(65) Prior Publication Data

US 2003/0110915 A1 Jun. 19, 2003

(51) Int. Cl.[7] ..... B26F 3/02

(52) U.S. Cl. ..... 83/649; 83/322; 83/337; 242/564; 225/16; 225/34

(58) Field of Search ..... 83/337, 42, 322, 83/345, 650, 649; 242/55.3, 564, 553; 225/2, 16, 34, 96

(56) References Cited

U.S. PATENT DOCUMENTS

| | | | | | |
|---|---|---|---|---|---|
| 2,278,029 | A | | 3/1942 | Walsh et al. | |
| 2,560,061 | A | | 7/1951 | Agamaite, Jr. | |
| 3,672,552 | A | * | 6/1972 | Krueger et al. | 226/129 |
| 3,739,965 | A | | 6/1973 | Jespersen et al. | |
| 3,896,691 | A | | 7/1975 | Granger et al. | |
| RE28,911 | E | * | 7/1976 | Jespersen et al. | 225/96 |
| 3,998,120 | A | | 12/1976 | Granger et al. | |
| 4,106,684 | A | * | 8/1978 | Hartbauer et al. | 226/91 |
| 4,122,738 | A | | 10/1978 | Granger | |
| 4,142,431 | A | | 3/1979 | Jespersen | |
| 4,188,844 | A | | 2/1980 | DeLuca | |
| 4,203,562 | A | | 5/1980 | DeLuca et al. | |
| 4,206,858 | A | | 6/1980 | DeLuca et al. | |
| 4,213,363 | A | | 7/1980 | Granger | |
| 4,276,797 | A | | 7/1981 | Baumann et al. | |
| 4,286,489 | A | | 9/1981 | DeLuca | |
| 4,307,638 | A | | 12/1981 | DeLuca et al. | |
| 4,307,639 | A | * | 12/1981 | DeLuca | 83/337 |
| 4,340,195 | A | | 7/1982 | DeLuca | |
| 4,358,169 | A | | 11/1982 | Filipowicz et al. | |
| 4,404,880 | A | | 9/1983 | DeLuca | |
| 4,432,261 | A | | 2/1984 | DeLuca | |
| 4,441,392 | A | | 4/1984 | DeLuca | |
| 4,552,315 | A | | 11/1985 | Granger | |
| 4,621,755 | A | | 11/1986 | Granger | |
| 4,635,837 | A | | 1/1987 | Granger | |
| 4,712,461 | A | | 12/1987 | Rasmussen | |
| 4,846,035 | A | | 7/1989 | Granger | |
| 5,048,386 | A | | 9/1991 | DeLuca et al. | |
| 5,107,734 | A | * | 4/1992 | Armbruster | 83/205 |
| 5,161,723 | A | * | 11/1992 | Wirtz-Odenthal | 225/14 |
| 5,203,036 | A | * | 4/1993 | Juushi | 4/243.3 |
| 5,441,189 | A | | 8/1995 | Formon et al. | |
| 5,630,526 | A | * | 5/1997 | Moody | 221/45 |
| 5,979,822 | A | * | 11/1999 | Morand et al. | 242/564.2 |
| 6,079,305 | A | * | 6/2000 | Bloch et al. | 83/335 |

FOREIGN PATENT DOCUMENTS

| | | |
|---|---|---|
| EP | 0930039 A1 | 7/1999 |
| WO | WO9214590 | 9/1992 |

OTHER PUBLICATIONS

US 4,176,569, 12/1979, DeLuca (withdrawn)

* cited by examiner

*Primary Examiner*—Allan N. Shoap
*Assistant Examiner*—Phong Nguyen
(74) *Attorney, Agent, or Firm*—Dority & Manning, P.A.

(57) ABSTRACT

A roll web guide system for defining a web travel path in a dispenser is provided. The web guide system includes a drive roller that is rotatably mounted within the dispenser. The drive roller defines at least one annular groove. A guide roller is also present. The guide roller is urged toward the drive roller to form a nip with the drive roller. The guide roller defines at least one annular groove therein. A plurality of stripper guides are partially disposed within the annular grooves of the guide roller and drive roller. The stripper guides prevent the web from wrapping around the guide roller and the drive roller.

26 Claims, 9 Drawing Sheets

ROLLED WEB DISPENSER AND CUTTING APPARATUS

The present application is related by subject matter to commonly owned U.S. Pat. No. 6,079,305, which is hereby incorporated by reference for all purposes.

TECHNICAL FIELD

The present invention relates generally to dispensing a rolled paper product, and more particularly, to an improved rolled paper dispenser which automatically severs or partially severs the rolled web into sheets as the web is dispensed.

BACKGROUND

There are a number of dispensers known in the art for dispensing and cutting paper towels. Many of such dispensers include a serrated edge against which the tail of the rolled paper can be pulled to effect a tear.

Also known in the art are devices where the user pulls the tail of the rolled paper towel and the towel is automatically severed at a pre-determined length as it is dispensed. These dispensers are typically referred to as "no-touch" dispensers. Examples of these types of apparatus are shown in U.S. Pat. No. 4,122,738 and U.S. Pat. No. 4,213,363, both to Granger. The apparatus taught in such patents include a rotating drum having a cutting means pivotably mounted within the drum. As the tail of the paper towel is pulled across the drum, the drum is caused to rotate and the rotation of the drum simultaneously rotates a cam which causes the cutting member to pivot out through a slot in the drum and sever the paper towel.

A modification of the above described Granger towel dispensers is disclosed in U.S. Pat. No. 4,635,837 also to Granger. The paper towel dispenser described in such patent includes a shaft mounted for free rotation at the lower opening of the dispenser for guiding the paid off web and for preventing unintentional engagements with the user's fingers. The shaft is provided with a circumferential groove, as is the drum, allowing for the resident of a drive belt therein. The rotating drum again includes cutting means pivotably mounted within the drum with, such cutting means divided, for example as two separate half blades, to avoid interference with the belt.

U.S. Pat. No. 4,712,461 to Rasmussen teaches yet another rolled web dispenser which automatically severs the web at a predetermined length when the user pulls on the tail of the rolled web. Rasmussen employs a cutting blade adapted to reciprocate within a rotating drum such that the blade extends through the slot in the drum surface at a predetermined location. Pins extending from the ends of the blade reside in slots in the end of the drum to govern the direction of the blade movement. A cam follower extending from two of the pins cooperates with a stationary cam to create the reciprocating motion.

SUMMARY

Objects and advantages of the invention will be set forth in the following description, or may be obvious from the description, or may be learned from practice of the invention.

The present invention provides for a dispenser for delivering and severing sheets of web from a roll of the web material. The dispenser includes a housing that defines a compartment where the housing has a dispensing slot therein. A roll holder is located in the compartment for holding a roll of the web material, and a frame is also mounted within the compartment.

A drive roller is present that is rotatably supported on the frame. The drive roller has a slot, and defines at least one annular groove. A cutting blade support member is present that is rotationally supported on the frame. The cutting blade support member is substantially parallel to the drive roller. The cutting blade support member has a cutting blade extending therefrom.

A guide roller is present and is supported by the frame. The guide roller is urged towards the drive roller so as to form a nip with the drive roller. The drive roller is driven by the action of a user pulling on a tail of the web material that passes through the nip and extends through the dispensing slot. The guide roller has at least one annular groove defined therein.

The cutting blade is geared to the drive roller so that rotation of the drive roller causes rotation of the cutting blade support member. This causes the cutting blade support member to be inserted into the slot to perforate the web. This allows the user to separate a sheet of the web from the roll.

A plurality of stripper guides may be provided that are partially disposed within the annular grooves of the guide roller and the drive roller. The stripper guides prevent the sheets from wrapping around the guide roller and the drive roller during dispensing.

The present invention may also include an embodiment of a dispenser as discussed above which further has at least one spring that is used to urge the guide roller toward the drive roller.

Another aspect of the present invention includes a web guide system for defining a web travel path in a dispenser. The guide system includes a drive roller that is rotatably mounted within the dispenser. The drive roller defines at least one annular groove. A guide roller is urged toward the drive roller to form a nip with the drive roller. The guide roller defines at least one annular groove therein. A plurality of stripper guides are also present. The stripper guides are partially disposed within the annular grooves of the guide roller and drive roller. The stripper guides prevent the web from wrapping around the guide roller and the drive roller.

A further aspect of the present invention includes a dispenser for delivering and severing sheets of web from a roll of web material. The dispenser comprises a housing that defines a compartment in which the roll is maintained. A roll holder is located in the housing for supporting the roll. Further, a frame is attached to the housing. A drive roller is rotatably supported on the frame. The drive roller defines at least one annular groove therein. A cutting blade support member is rotatably supported in the frame and is substantially parallel to the drive roller. The cutting blade support member has a cutting blade extending therefrom. Also, a guide roller is supported by the frame and is urged by at least one spring toward the drive roller to form a nip with the drive roller. The drive roller is driven by the action of a user pulling on a web tail of the roll. The guide roller defines at least one annular groove therein.

A plurality of stripper guides may be present which are partially disposed within the annular grooves of the guide roller and the drive roller. The stripper guides prevent the sheets from wrapping around the guide roller and drive roller during dispensing. The stripper guides also ensure that the web remain proximate to the drive roller when the web is wound around the drive roller.

The present invention also includes an embodiment of the roll towel dispenser as discussed above where the roll holder is pivotable with respect to the frame.

BRIEF DESCRIPTION OF THE DRAWINGS

FIG. 9 is taken from FIG. 3 of U.S. Pat. No. 6,079,305. This drawing in particular shows components of the dispenser and cutting apparatus that allow for automatic transfer, braking, and cutting.

FIG. 10 is taken from FIG. 16 of U.S. Pat. No. 6,079,305.

FIG. 11 is taken from FIG. 14 of U.S. Pat. No. 6,079,305.

FIG. 12 is taken from FIG. 1 of U.S. Pat. No. 6,079,305.

DETAILED DESCRIPTION

Figure 1:
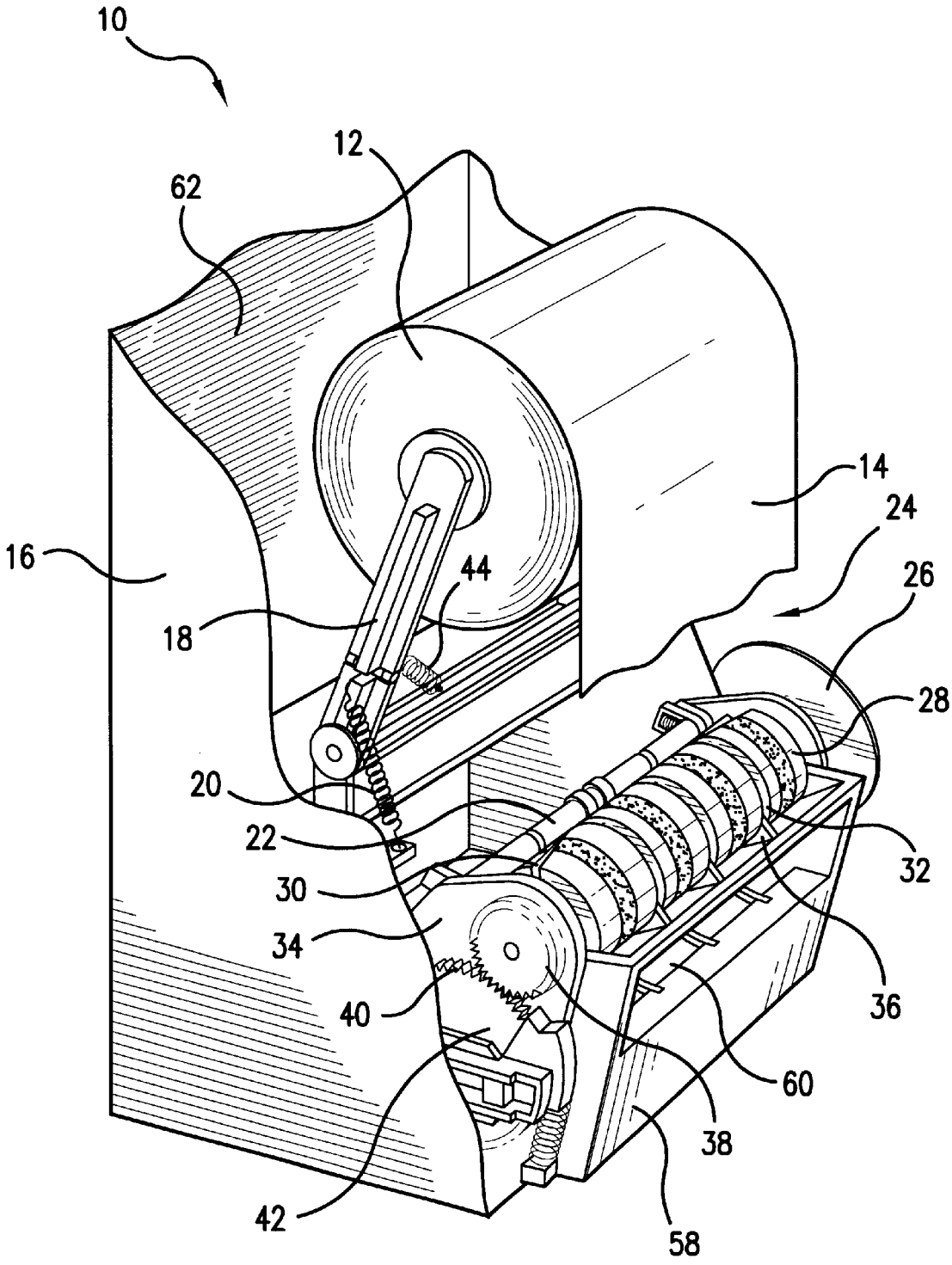
FIG. 1 is a perspective view of a dispenser and cutting apparatus of the present invention. The drawing shows the roll pivotably raised from the drive roller.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

Turning now to the figures, FIG. 1 shows a "hands-free" or "no-touch" dispenser 10. No-touch dispensers are advantageous in that a user may dispense a sheet of towel without having to touch any surface of the dispenser. This feature prevents the spreading of germs and other infectious agents from one user to another in whatever location the roll towel dispenser 10 is situated. The present application contains several features similar to those disclosed in U.S. Pat. No. 6,079,305 which is assigned to the assignee of the present application and is incorporated herein by reference in its entirety for all purposes.

FIG. 1 shows the components of a roll towel dispenser 10 being disposed within housing 16. It is to be understood that housing 16 may be configured in any number of ways to house the components of the roll towel dispenser 10 and to provide for an aesthetic appearance to the outside shape of the roll towel dispenser 10. Housing 16, including the rear housing 62 and front housing 58, are only partially shown in the figures in order to allow for proper viewing of the components of the roll towel dispenser 10. A towel roll 12 is rotatably mounted onto a pivotable roll holder 18. The roll 12 may be of any number of paper products such as, for instance, hand towels or toilet tissue. The roll 12 consists of a web 14 that is unwound therefrom.

The embodiment shown in FIG. 1 includes a pivotable roll holder 18 that is pivotable with respect to the frame 34. A clamping mechanism 44 that may be, for example, a spring is configured to engage either one or both of the ends of the pivotable roll holder 18. The purpose of clamping mechanism 44 is to urge one end of the pivotable roll holder 18 towards another. This urging function allows for the pivotable roll holder 18 to better grasp the roll 12. A pivotable roll holder spring 20 may be engaged on either one or both ends of the pivotable roll holder 18. The purpose of pivotable roll holder spring 20 is to urge the roll 12 down onto the drive roller 28. However, some embodiments of the present invention may not include a pivotable roll holder spring 20, but may simply allow for the roll 12 to lay by its own weight onto the drive roller 28. A specific advantage of having a pivotable roll holder 18 is that the pivoting function allows for the roll 12 to be kept in a specific location on top of the drive roller 28. The pivotable roll holder spring 20 is also advantageous in that it allows for a specific contact force to be imparted between the roll 12 and the drive roller 28. Such control over the contact force and orientation of these two components provides for more consistent and reliable dispensing of towels from the roll dispenser 10.

Another main component of the dispenser 10 shown in FIG. 1 is drive roller 28. Drive roller 28 may have an annular groove 32 defined therein. Three such annular grooves 32 of drive roller 28 are shown in FIG. 1. The annular grooves 32 circumvent the entire circumference of drive roller 28. A slot 30 of drive roller 28 is also partially shown in FIG. 1. Although not clearly visible in FIG. 1, slot 30 is chevron shaped, and runs substantially the full length of drive roller 28. Drive roller 28 is rotatable with respect to the frame 34 and is in contact with a guide roller 22. Although two or more guide rollers 22 may be used in different configurations of the present invention, only one guide roller 22 is shown in the embodiment in FIG. 1.

Guide roller 22 and drive roller 28 contact one another to form a nip 64, wherein the web 14 is inserted through this nip 64 and driven through the dispenser 10. As with drive roller 28, the guide roller 22 is rotatable with respect to frame 34. The rotation of both guide roller 22 and drive roller 28 is effected by a user pulling the web 14 from the dispenser 10. This aspect will be explained later in the Description. If web 14 breaks or tears improperly and prevents a user from subsequently grasping the next sheet of the web 14, a rotary knob 26 is provided which engages drive roller 28 and allows for a user to manually rotate drive roller 28.

Drive roller 28 is attached to a drive gear 38 of the drive roller 28. The drive gear 38 may have teeth located on its entire circumference or less than its entire circumference. The teeth of drive gear 38 contact a spur gear 40 of the cutting blade support member 42. The cutting blade support member 42 houses a cutting blade 66 that engages the slot 30 of drive roller 28. Upon doing so, the web 14 is cut which therefore allows a user to pull a single sheet from the dispenser 10. The web 14 is pulled from the dispenser 10 through a dispensing slot 60.

Figure 2:
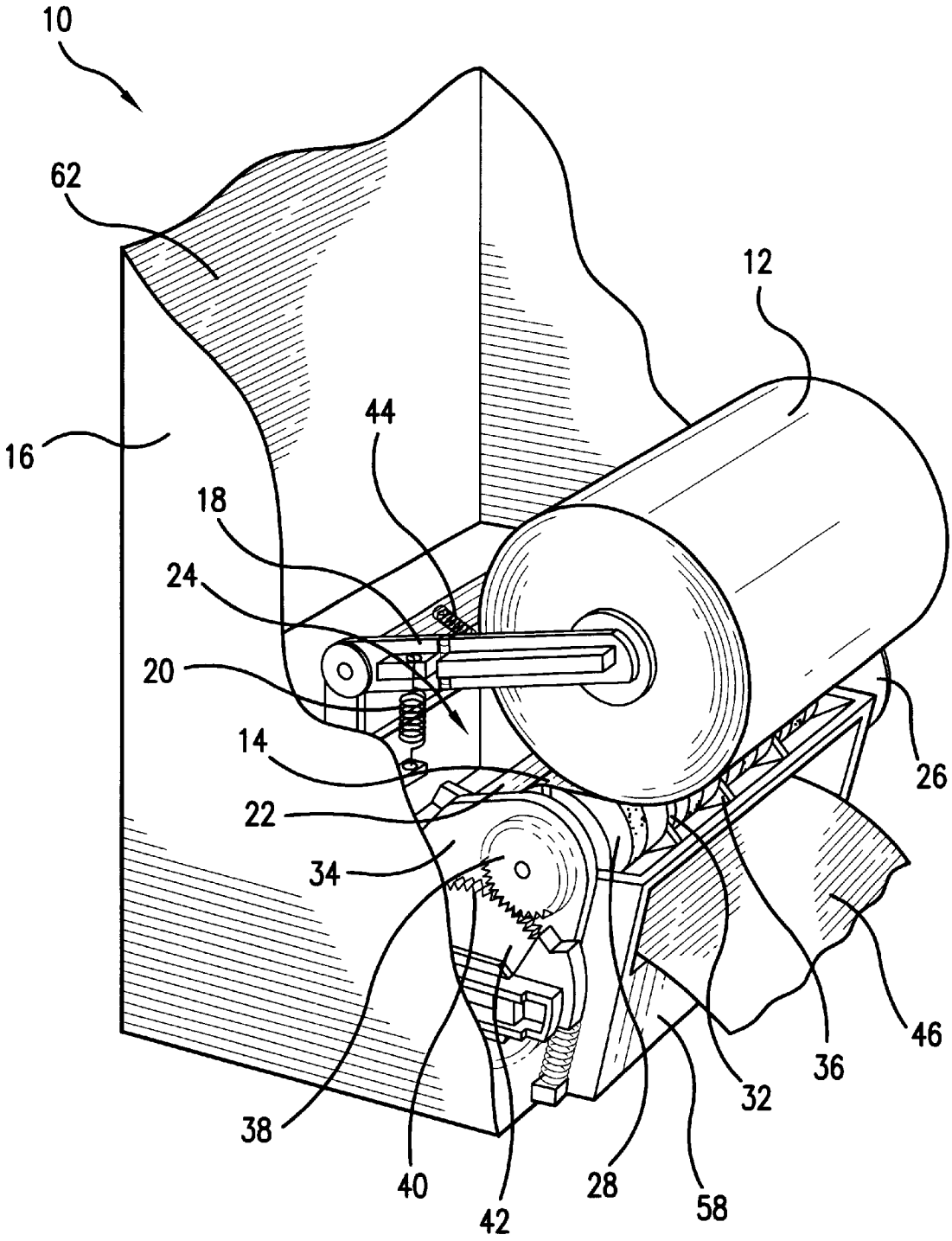
FIG. 2 is perspective view of a dispenser and cutting apparatus of the present invention. The drawing shows the roll being rested on top of the drive roller.

FIG. 2 shows the roll 12 being urged against the drive roller 28, and the tail 46 of the roll 12 being pulled through the dispensing slot 60. In addition, FIG. 2 also shows the web 14 engaging the drive roller 28 and traveling past both the guide roller 22 and the drive roller 28.

Figure 3:
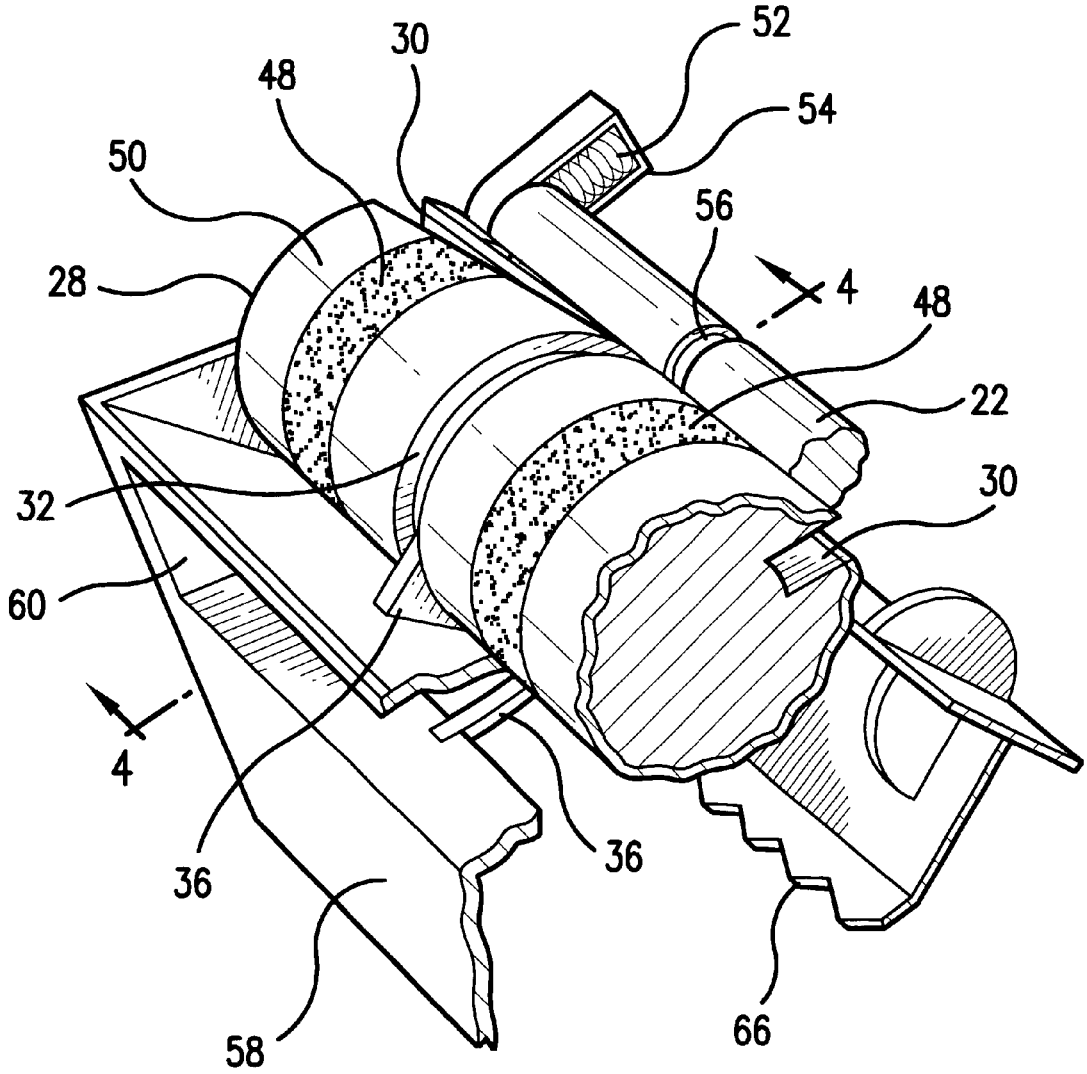
FIG. 3 is a partial perspective view of a section of the dispenser and cutting apparatus. This partial section view shows in greater detail the configuration of the drive roller, guide roller, and stripper guides.

FIG. 3 shows a partial perspective view of the guide roller 22 and drive roller 28. Advantageously, the drive roller 28 may have a high friction surface 48 applied along its length or a portion of its length. In some embodiments, this high friction surface 48 may be a strip of high friction material that is disposed between sections of lower friction material 50 along the surface of drive roller 28. The high friction surface 48 may be covered with an abrasive medium that creates a high co-efficient of friction between the web 14 and the drive roller 28. Such an arrangement ensures there is no slippage between the web 14 and the surface of drive roller 28 during dispensing. Problems may arise in which the web 14 begins to slip around the drive roller 28 causing the mechanism to malfunction, resulting in jamming or towel length variations.

Referring back to FIG. 1, the spur gear 40 of the cutting blade support member 42 is geared with the drive gear 38 of the drive roller 28. The drive roller 28 and cutting blade support member 42 may in one embodiment be geared in such a way that the drive roller 28 makes two revolutions for every one revolution of the cutting blade support member 42. The web 14 is cut when the edge of the cutting blade 66 (FIG. 4) makes a complete revolution and pierces the web 14 in slot 30 of the drive roller 28. Slot 30 and cutting blade 66 may be more easily seen in FIG. 3. Several springs may be attached to the cutting blade support member 42 and the drive roller 28 to allow the configuration to store up potential energy as the web 14 is pulled. Once the springs and a crank assembly (discussed later) pass atop dead center, the potential energy is released and the configuration causes the cut end of the web 14 to eject itself out of the dispensing slot 60. This allows a user to grab the tail 46 and repeat the cycle.

Referring back to FIG. 3, as the web 14 moves around drive roller 28 it is also urged and guided by the guide roller 22. In one embodiment of the present invention, guide roller 22 may be urged against the drive roller 28 by use of a guide roller spring 52. The guide roller spring 52 is housed within a guide roller spring bracket 54. A guide roller spring 52 may be included on either one or both ends of the guide roller 22 to urge the guide roller 22 against the drive roller 28. This urging effect helps to maintain the web 14 in contact with the drive roller 28 as web 14 moves through the configuration. Again, web 14 may be prevented from slipping, that is where the drive roller 28 rotates but the web 14 remains stationary, by the use of a high friction surface 48 on drive roller 28.

Figure 4:
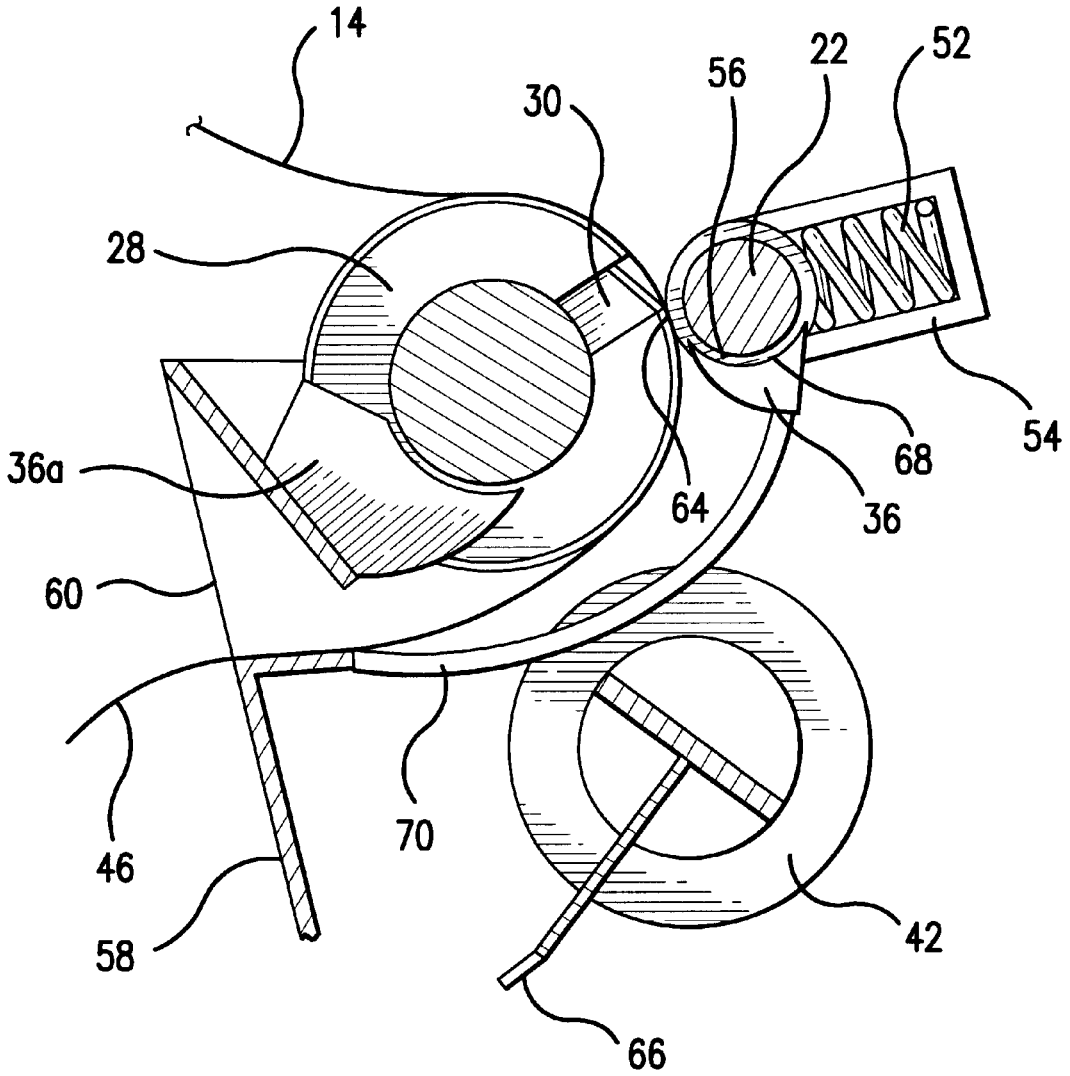
FIG. 4 is a cross sectional view taken along line 4—4 of FIG. 3. The drawing shows the web path of a web being inserted through the dispenser and cutting apparatus.
Figure 5:
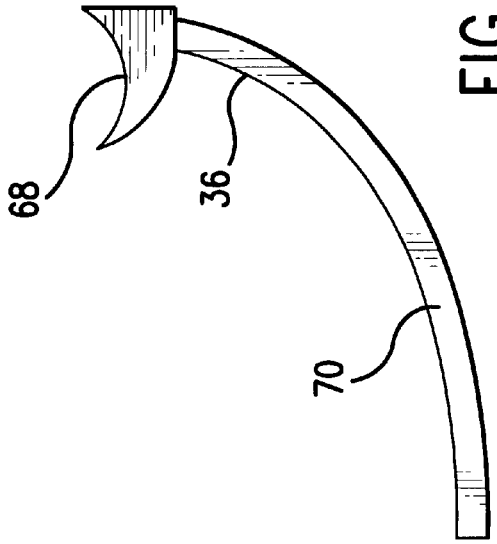
FIG. 5 is an elevational view of a stripper guide used in a dispenser and cutting apparatus.
Figure 7:
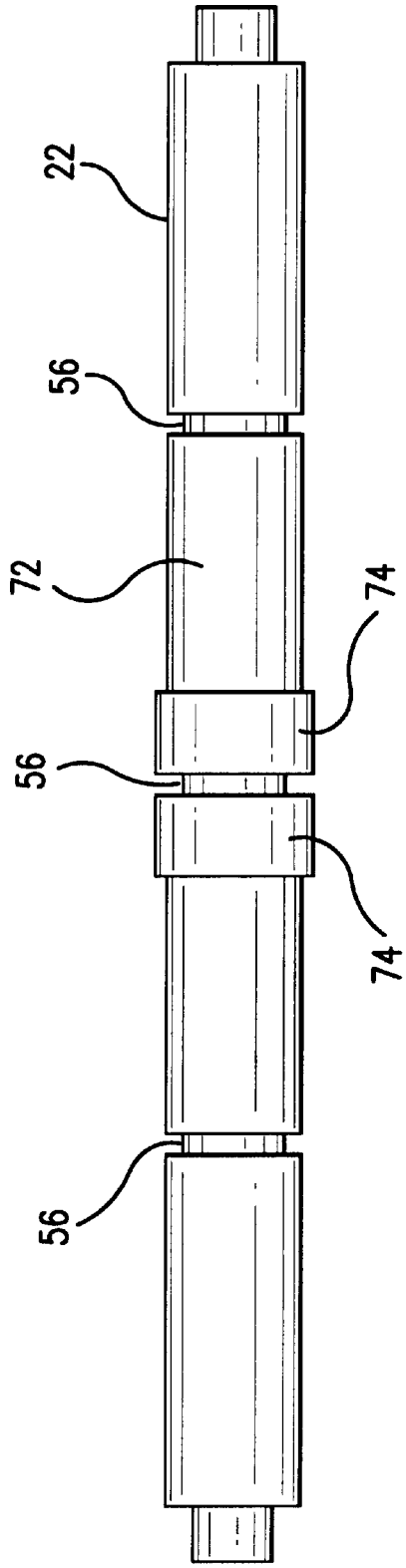
FIG. 7 is an elevational view of a guide roller. The embodiment shown in FIG. 7 has a middle section that is of greater diameter than the remaining length of the guide roller.

FIG. 4 shows the web path of web 14 in one embodiment of the present invention. FIG. 4 is a cross sectional view taken along line 4—4 of FIG. 3. A nip 64 may be seen that is formed by the contact of the guide roller 22 and the drive roller 28. In addition to helping the web 14 maintain contact with the drive roller 28, nip 64 may also be employed to help keep the web 14 from skewing side to side on the drive roller 28. It may be the case that web 14 will have a tendency to wrap around the guide roller 22 instead of the drive roller 28 once passing nip 64. In order to prevent this from happening, at least one stripper guide 36 may be employed. The stripper guide 36 which prevents the web 14 from rotating around the guide roller 22 in FIG. 4 is shown in FIG. 5. The embodiment of a stripper guide 36 shown in FIG. 5 has curved section 68 on one end and an elongated section 70 on another end. The embodiment of a guide roller 22 shown in FIG. 7 has three annular grooves 56 located along its length. The annular grooves 56 circumvent the entire circumference of the guide roller 22. Referring back to FIG. 4, the curved section 68 of stripper guide 36 may be partially disposed within one of the annular grooves 56 of the guide roller 22. When doing so, if web 14 remains in contact with the guide roller 22 after passing by nip 64, it will be "stripped" from the guide roller 22 by the stripper guide 36. This occurs when the web 14 contacts the stripper guide 36 and is moved away from and out of contact with the guide roller 22. Having stripper guide 36 allows for the surface of the guide roller 22 to be provided with a higher frictional surface 72. Although it is not necessary to provide a higher frictional surface 72 onto guide roller 22, such configuration can be realized.

Additionally, an area of large diameter 74 may be provided about the center of guide roller 22 in one embodiment of the present invention. Having large area 74 located near the center of guide roller 22 may provide for the creation of an optimal nip 64. It has been found that having a nip 64 located at this section as opposed to along the entire length of guide roller 22 prevents the web 14 from skewing to one side during dispensing, and also urges the web 14 back to the center of guide roller 22 once it becomes skewed. In essence, the area of large diameter 74 can both prevent and correct for skewing of the web 14 in addition to providing for an optimal nip 64. However it is to be understood that the present invention is not limited to an area of large diameter 74 being located on the guide roller 22.

Once the web 14 passes through nip 64 and is either contacted or not contacted by the stripper guides 36, the web 14 travels around the drive roller 28. It may be the case that web 14 will fall from the drive roller 28 and not maintain contact with drive roller 28. In light of this fact, the stripper guides 36 have been provided with the elongated section 70. The elongated section 70 substantially follows the radial path of drive roller 28 and will catch the web 14 if it becomes disengaged from drive roller 28. This prevents the web 14 from falling down into other components of the dispenser 10 and becoming jammed therewith. The elongated section 70 also provides for funneling the web 14 into its appropriate travel path. It is to be understood that any number of the stripper guides 36 may be employed in the present invention. The embodiment shown in FIG. 1 and the guide roller shown in FIG. 7 both are configured to employ three stripper guides 36 for the guide roller 22, however as stated any number may be used.

Figure 6:
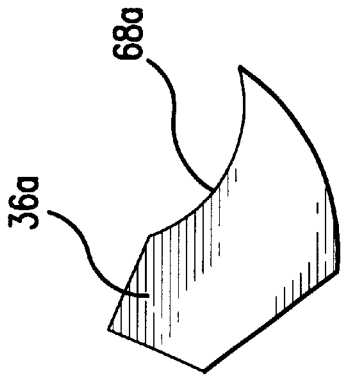
FIG. 6 is an elevational view of another embodiment of a stripper guide used in a dispenser and cutting apparatus.

In the case that web 14 remains contacted with drive roller 28 and does not become disengaged from drive roller 28, stripper guides 36*a* are employed. An embodiment of stripper guides 36*a* that may be used in one embodiment of the present invention is shown in FIG. 6. This embodiment of stripper guides 36*a* also has a curved section 68*a*. However, it is to be understood that a stripper guide 36*a* may be designed such that it does not have a curved section 68*a*, and such modification is considered to be within the scope of the present invention. Referring back to FIG. 3, the drive roller 28 is shown having an annular groove 32 disposed about the circumference of drive roller 28. Three such annular grooves 32 are shown in the embodiment in FIG. 1. The stripper guides 36*a* may be attached on one end to the front housing 58. Additionally, the stripper guides 36*a* may be attached to either the frame 34 or even the rear housing 62. However, the embodiment in FIG. 4 shows the stripper guide 36*a* being attached to the front housing 58 on one end. The curved section 68*a* is disposed within the annular groove 32. If the web 14 remains contacted with the drive roller 28 during rotation about the drive roller 28, the web 14 will be "stripped" from the drive roller 28 once the web 14 contacts the stripper guide 36*a*.

Figure 8:
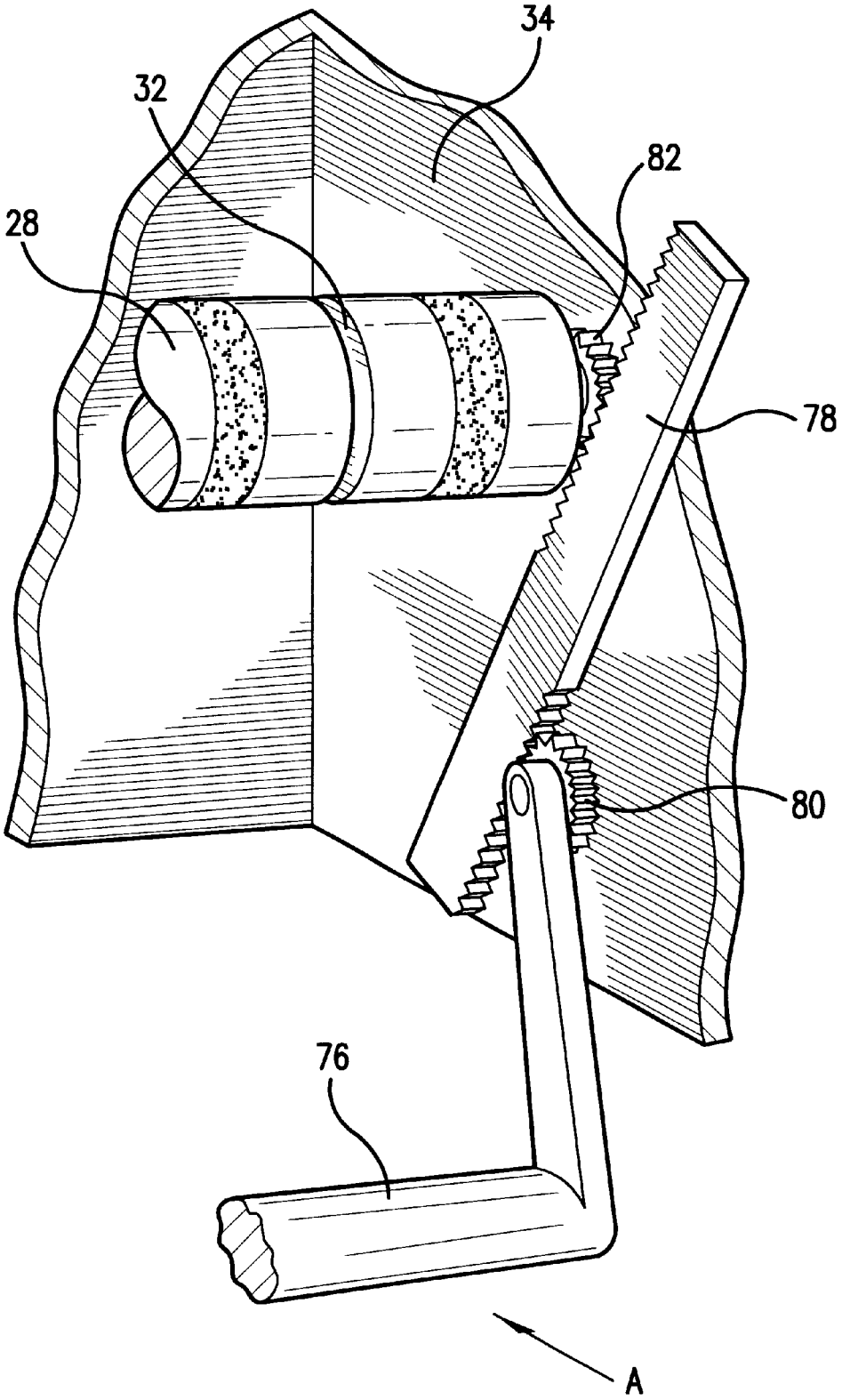
FIG. 8 is a perspective view of a push bar arrangement used on a dispenser and cutting apparatus.

It may be the case that the web 14 becomes jammed within the components of the roll dispenser 10. It may also be the case that the tail 46 of the roll material is not presented to a user to pull a subsequent sheet. In such cases, it is necessary that an emergency feed push system be provided to enable a user to manually dispense towels from the dispenser 10. A rotary knob 26 is disclosed in FIG. 1 for accomplishing such a task. A user will rotate the rotary knob 26 to manually drive drive roller 28, drive roller 28 being engaged by the rotary knob 26. However, it is often the case that the dispenser 10 is used within a public restroom that is subjected to standards governed by the Americans with Disabilities Act of 1990. Such an Act may require the dispenser 10 to be accommodating to persons with physical handicaps. In these circumstances, it may be the case that a rotary knob 26 is not in compliance with the appropriate standards as a handicapped individual may not be able to grasp the rotary knob 26 and affect a rotary motion. In these instances, a push type device is preferred and required by the Act. FIG. 8 shows a push bar 76 that may be employed. Push bar 76 has a push bar pinion 80 engaging one end thereof A rack 78 with teeth on oppositely disposed ends is in contact with the push bar pinion 80. Rack 78 is also in contact with a pinion 82 that is engaged with the drive roller 28. It can be seen from the configuration in FIG. 8 that if a user pushes in the direction of arrow A on the push bar 76, the motion will be translated into a rotational movement of the drive roller 28. Such an arrangement allows for manually dispensing towel from the dispenser 10 in the case of jamming or if manual dispensing is desired. FIG. 8 shows one embodiment of an emergency feed push system that may be used, however it is to be understood that one skilled in the art may use other methods of converting a linear motion into a rotational motion in the present invention.

Now discussed will be features disclosed in U.S. Pat. No. 6,079,305 which is incorporated herein in its entirety for all purposes. It is to be understood that the features discussed are only one way of configuring an automatic transfer mechanism, braking mechanism, and other features in the present invention. Other ways of accomplishing the features set forth are possible. Some of the following description and accompanying figures have been taken from the '305 patent.

Figure 9:
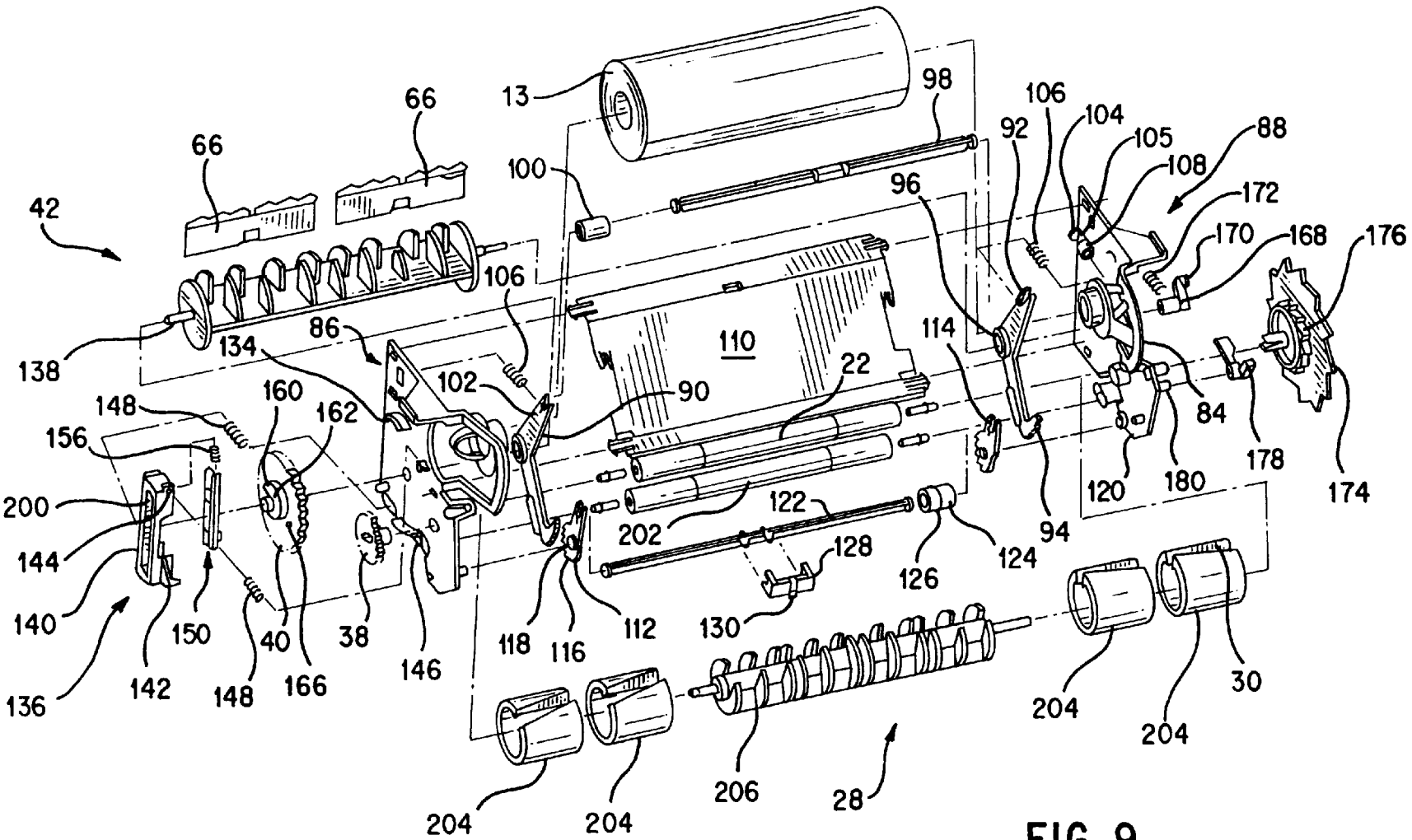
FIG. 9 PRIOR ART
FIG. 9 is an exploded assembly view of another embodiment of the dispenser and cutting apparatus.

One embodiment of the present invention may include a second roll 13 that is dispensed by an automatic transfer system that feeds the tail of the first roll to the drive roller 28 when the second roll 13 has been exhausted to a predetermined extent. Such an automatic transfer mechanism automatically feeds the tail from the first roll to the nip 64 between drive roller 28 and guide roller 22 when the second roll 13 (hereafter "stub" roll 13) is almost spent. Such an embodiment is shown in FIG. 9 which is an alteration of the embodiment shown in FIG. 1. The stub roll 13 is supported on stub roll brackets 84 extending from a left and a right side plate 86, 88. The automatic transfer mechanism includes a first pair of rocker arms 90, one of the first rocker arms 90 being located at each end of the cutting blade support member 42. Each of the rocker arms 90 include a sensor support member 92 and a gear member 94. There is a journal bearing 96 located substantially at the intersection of the sensor support member 92 with the gear member 94. Each gear member 94 includes a plurality of gear teeth on the distal end thereof. Extending across the support members 92 and affixed thereto is a sensor 98. Rotatably mounted on the sensor 98 is a sensor roller 100. Each sensor support member 92 may have a prong 102 extending therefrom. There is a bracket 104 extending from the inside surface of the left and the right side panels 86 and 88 in general alignment with prongs 102. Projecting from the brackets 104 toward the prong 102 is a second prong 105. A coil spring 106 fits over the prongs 104, 105 and extends therebetween to thereby bias the sensor support members 92 and the sensor 98 toward the stub roll 13. A U bracket 108 may be provided on the inside surface of the left and right side panels 86, 88 to ensure that the coil springs 106 remain properly aligned. The sensor support members 92 extend through blade cover 110 at notches. The sensor roller 100 is free to rotate and thus reduce drag on the web 14 generated by the force of the coil springs 106 biasing the sensor support members 92 and the sensor 98 toward the stub roll 13.

The automatic transfer mechanism may also include second rocker arms 112. Each second rocker arm 112 may include a transfer rod support member 114, a geared surface 116, and a journal bearing 118. The second rocker arm 112 is supported on pins 120 extending from the inside surfaces of left and right side plates 86 and 88. There is a transfer rod 122 which is affixed at each end to one of the transfer rod support members 118. Rotatably supported on the transfer rod 122 is a transfer roller 124. The transfer roller 124 rotates freely on the transfer rod 122 and thus reduces drag on the web 14 at the nip between the transfer rod 122 and the transfer roller 124 and the drive roller 28. The transfer roller 124 includes an annular projection 126 which aligns with the annular groove 32 located substantially at the mid point of the drive roller 28, and the annular groove 56 located substantially at the mid point of the upper guide roller 22. There is a channel bracket 128 attached to the transfer rod 122 extending around the transfer roller 124. Projecting from the channel bracket 128 is a pin 130. When the primary roll is first loaded, the tail of the primary roll is taken beneath the upper guide roller 22, wrapped partially thereabout and impaled on the pin 130. The geared surfaces 116 of the second rocker arm 112 mesh with the gear member 94 of the first rocker arm 90.

The automatic transfer system operates such that the coil springs 106 bias the sensor support member 92 and the sensor 98 to pivot about the journal bearings 96 to thereby maintain the sensor roller 100 in contact with the outside surface of the stub roll 13 which is supported by the stub roll brackets 84. As the stub roll 13 is deplenished, the concomitant rotational movement of the sensor support members 92 results in rotational movement of the gear members 94. With the gear teeth intermeshing with the geared surface 116 of the transfer rod support member 114 rotational movement is also imparted to the second rocker arms 112 pivoting about the journals 118. Thus, as the stub roll 13 is deplenished, the transfer rod support members 114 are driven closer toward the nip between the drive roller 28 and the upper guide roller 22. When the stub roll 13 is nearly spent, the transfer roller 124 presses the tail of the primary roll against the drive roller 28 in close proximity to the nip 64 between the drive roller 28 and the upper guide roller 22. The annular projection 126 which aligns with the center annular groove 32 on drive roller 28 and with the center annular groove 56 on the upper guide roller 22 actually enters into the grooves 56, 32 when the stub roll 13 is sufficiently depleted. This action ensures that the tail of the primary roll will be pinched in the nip 64 between the drive roller 28 and the upper guide roller 22 and drawn therein. Once the web 14 is grasped by the nip 64, it is torn from pin 130 and dispenses simultaneously with the remaining web 14 on the stub roll 13. When the stub roll 13 is fully spent, then the web 14 from the primary roll is dispensed alone. When the primary roll has sufficiently decreased in diameter, it can be relocated to be supported on the stub roll brackets 84 with a new primary roll inserted on the primary roll holders 132.

Alternatively, a travel stop (not shown) may be provided to limit the amount of rotation available to the first rocker arm 90 and the second rocker arm 112. Over rotation may allow the gear member 94 to disengage from the geared surface 116.

Figure 10:
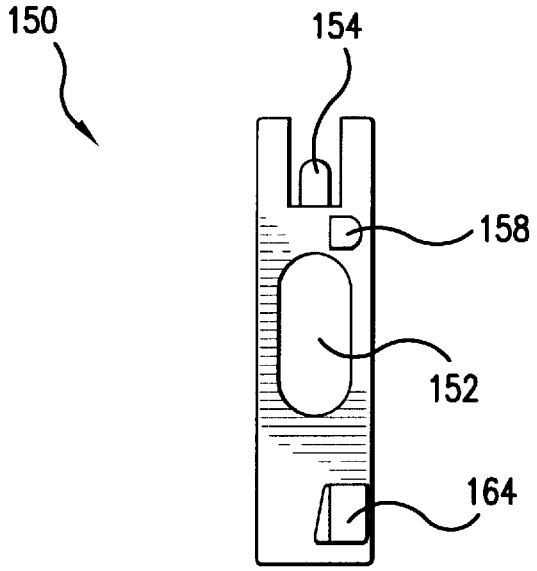
FIG.10 PRIOR ART
FIG. 10 is a front elevation view of a piston that can be employed on the dispenser and cutting apparatus.
Figure 11:
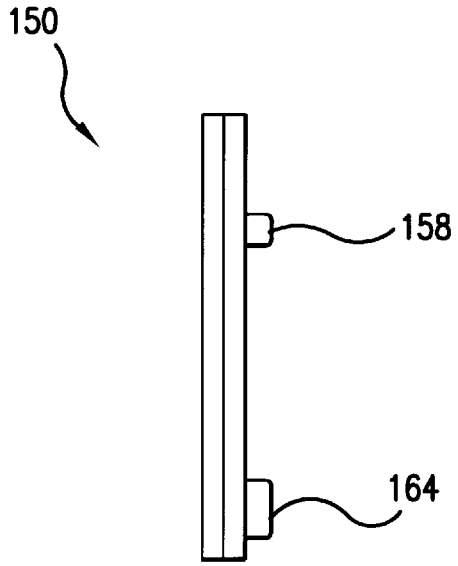
FIG.11 PRIOR ART
FIG. 11 is a side elevational view of a piston that can be employed on the dispenser and cutting apparatus.

The dispenser 10 of the present invention may further include a braking mechanism. The braking mechanism may include a pair of arcuate brackets 134 extending from the left side plate 86. Each arcuate bracket 134 includes a retaining clip (not shown). Residing between the arcuate bracket 134 is a shock absorbing member 136 which is adapted for intermittent rotational movement about a journal 138. The shock absorbing member 136 includes a shaft 140 having a gusset 142 extending from each end thereof Projecting perpendicularly from the gusset 142 is a radius ledge (not shown). Extending from one end of each radius ledge is a travel stop which normally resides abutting one end of the arcuate bracket 134. Retaining clips extend radially inwardly from the arcuate brackets 134 adjacent to the gussets 142 to prevent the shock absorbing member 136 from being laterally extracted off the journal 138 when the shock absorbing member 136 is in an operable position. Extending from the shock absorbing member 136 proximate to the travel stops and substantially perpendicular thereto are shanks 144. Extending out from the left side plate 86 are spring supports 146 which have shanks (not shown) projecting therefrom. Residing between the travel stops and the spring supports 146 are springs 148 which fit over the shanks. Residing slidably within the shaft 140 is a piston 150. The piston 150 is shown in greater detail in FIGS. 10 and 11. The piston 150 includes an elongate opening 152 through which the journal 138 on the left side of the cutting blade support member 42 inserts. Projecting from one end of the piston 150 substantially parallel to shaft 140 is a first nipple 154. Projecting from the inside surface of the shaft 140 toward and substantially co-linear with the first nipple 154 is a second nipple (not shown). There is a piston spring 156 which resides between the piston 150 and the inside surface of the shaft 140 retained on the first nipple 154 and the second nipple. The piston spring 156 is in compression thereby biasing the piston 150 towards the bottom of the shaft 140. Projecting from the inside surface of the piston 150 is a cam follower 158. The cam follower 158 works in conjunction with the jumping cam 160 affixed to the spur gear 40. The jumping cam 160 is eccentric and has a cam surface 162 of increasing radius which is followed by the cam follower 158 as the cutting blade support member 42 rotates.

Projecting from the inside surface of the piston 150 proximate to the bottom thereof is a brake stop 164. Extending from the outside surface of spur gear 40 is a gear stop 166.

Affixed to the portion of the journal 138 which extends through the right side plate 88 is the proximal end of a crank 168. Projecting from the distal end of the crank 168 is a post 170. A tension spring 172 extends between a prop (not shown) that is located on the right side plate 88 and the post 170.

Located on the outside of the side plate 88 and rotatable with respect to the side plate 88 is a threading wheel 174. The inside surface of the threading wheel 174 has a ratchet wheel 176 projecting therefrom. There is a pawl 178 supported on a post 180 extending from the right side plate 88. Also extending from the right side plate 88 substantially adjacent to the post 180 is a pawl stop (not shown). The pawl 178 interacts with the ratchet wheel 176 to ensure that the drive roller 28 can be rotated in only one direction.

Under normal operation of the dispenser 10, the user is presented with a tail 46 of the web material projecting through the dispensing slot 60 on the bottom front portion of the front housing 58. The user grasps the towel and pulls. As the web 14 is pulled from the dispenser 10 around a peripheral segment of the drive roller 28, the drive roller 28 is caused to rotate resulting in the simultaneous rotation of the drive gear 38. The drive gear 38 drives the spur gear 40 which causes the cutting blade support member 42 and the cutting blade 66 supported therein to rotate. The ratio is such that for every two rotations of the drive roller 28, the cutting blade support member 42 and the cutting blade 66 rotates once. The timing is configured such that for each rotation of the cutting blade support member 42, the cutting blade 66 is caused to be inserted into the chevron shaped slot 30. This causes a series of large perforations to be imparted across the web 14.

During the rotation of the cutting blade support member 42 as the cutting blade 66 approaches the chevron shaped slot 30, the tension spring 172 is loaded or stretched. Therefore, the user pulls against the force of the spring 172. Slightly before the time the cutting blade 66 contacts the web 14 and thus enters the chevron shaped slot 30, the crank 168 has moved approximately 180° from its starting point. At that point, the tension in the spring 172 aids in driving the rotation of the cutting blade support member 42, and thus drive roll 28. As the tension in the tension spring 172 is unloaded, the added force aids in the cutting blade 66 perforating the web 14 and simultaneously ensures that the drive roll 28 will continue to rotate for a sufficient period to kick out an adequate length of the tail 46 for grasping by the next user. The threading wheel 174 has the primary purpose of allowing maintenance workers to be able to easily thread a new web 14 through the dispenser 10.

The threading wheel 174 is on the outside of the dispenser in case there has been a dispensing failure such as would be the case if sufficient tail 46 has not been presented for grasping by the user. In that case, the user can use the threading wheel 174 to rotate the drive roll 28 to kick out sufficient tail 46 for grasping. The ratchet wheel 176 in combination with the pawl 178 ensures that both the drive roll 28 and the cutting blade support member 42 can rotate in only one direction. This prevents the tension spring 172 from inappropriately reversing the rotation of the mechanism.

The braking mechanism of the present invention prevents a user from free spooling towels from the dispenser 10. In such a manner, the user must extract towels from the dispenser 10 in predetermined lengths. Prior to the grasping of the tail 46 by the user, the cam follower 158 will normally be in its at rest position against the cam surface 162 on the spur gear 40. The piston spring 156 biases the piston 150 downward to ensure the cam follower 158 follows the cam surface 162. As the cutting blade support member 42 rotates, the jumping cam 160 also rotates. The rotation of the jumping cam 160 causes the cam follower 158 and thus the piston 150 to move upward within the shaft 140 of the shock absorbing member 136. As the piston 150 moves upward, ultimately the brake stop 164 is moved into alignment with the gear stop 166. Upon rotation of the cam follower 158, the piston 150 falls abruptly with the shaft 140. However, if the user is rotating the drive roll 28 too quickly by attempting to remove towel too rapidly from the dispenser 10, the gear stop 166 will contact the brake stop 164 thereby momentarily stopping rotation of the drive roll 28 until the piston 150 falls within the shaft 140 such that the cam follower 158 reoccupies its normal at rest position at the base of the radial step of the spur gear 40.

The braking system may also in one embodiment have a shock absorbing system associated therewith. The shock absorbing member 136 is adapted for a small amount of rotation movement within and between the arcuate brackets 134. Springs 148 bias the shock absorbing member 136 such that travel stops 200 normally have an at rest position abutting one end of the arcuate brackets 134. When a user has caused the drive roll 28 and the cutting blade support member 42 to rotate too quickly thereby causing the gear stop 166 to ram into the brake stop 164, the force of the collision causes the shock absorbing member 136 to rotate a small distance against the force of the springs 148 thereby absorbing the shock of the collision. The springs 148 quickly return the shock absorbing member 136 to its normal at rest position. The springs 148 in combination with spring supports (not shown) also provide rotational travel limits for the shock absorbing member 136 in the direction of rotation opposite or against the biasing of the springs 148.

One aspect of the present invention includes the configuration where the cutting blade 66 is inaccessible by a user of the dispenser 10 and further, is inaccessible even by maintenance personnel who open the front housing 58 to refill the dispenser 10. Cowl 110 in combination with the drive roll 28 blocks all access to the blade 66 short of removing the frame formed of the left and the right side plates 86, 88 along with the cowl 110 from the dispenser 10. Even rotation by the hand or threading wheel 174 while the front housing 58 is open will not put the blade 66 in an accessible position. This negates the possibility of a user or a maintenance person replacing a spent roll from accidentally cutting or injuring their fingers.

A certain aspect of the present invention may have the cutting blade 66 configured in a chevron or flattened V-shape in order to ensure that the teeth of the blade do not contact the web 14 at the same time. If all of the teeth were to contact the web 14 at the same time, the force necessary to pull the web 14 through the dispenser 10 would increase, and further would promote the web 14 being pushed into the slot 30 of the drive roller 28 rather than be perforated by the teeth. The cutting blade 66 could also be one continuous spiral rather than V-shaped but then the cut or tear line through the web 14 would have a displeasing angle. However, it is to be understood that the shape and configuration of the cutting blade 66 may take any number of forms, and the present invention is not limited to one specific configuration.

Referring again to FIG. 9, it can be seen that a second guide roll 202 is present. The second guide roll 202 may or may not be present in other aspects and embodiments of the present invention. Also shown in FIG. 9 is the drive roll 28 composed of four outer sleeves 204 which slide over an inner drive roll member 206. Again, other aspects and embodiments of the present invention may have the drive roll 28 configured differently, for instance, by having the drive roll 28 be one solid part. Also shown in FIG. 9 is the cutting blade support member 42 that has two cutting blades 66 disposed therein. Other embodiments of the invention are possible wherein the cutting blade support member 42 and the blades 66 are formed integrally with one another.

Figure 12:
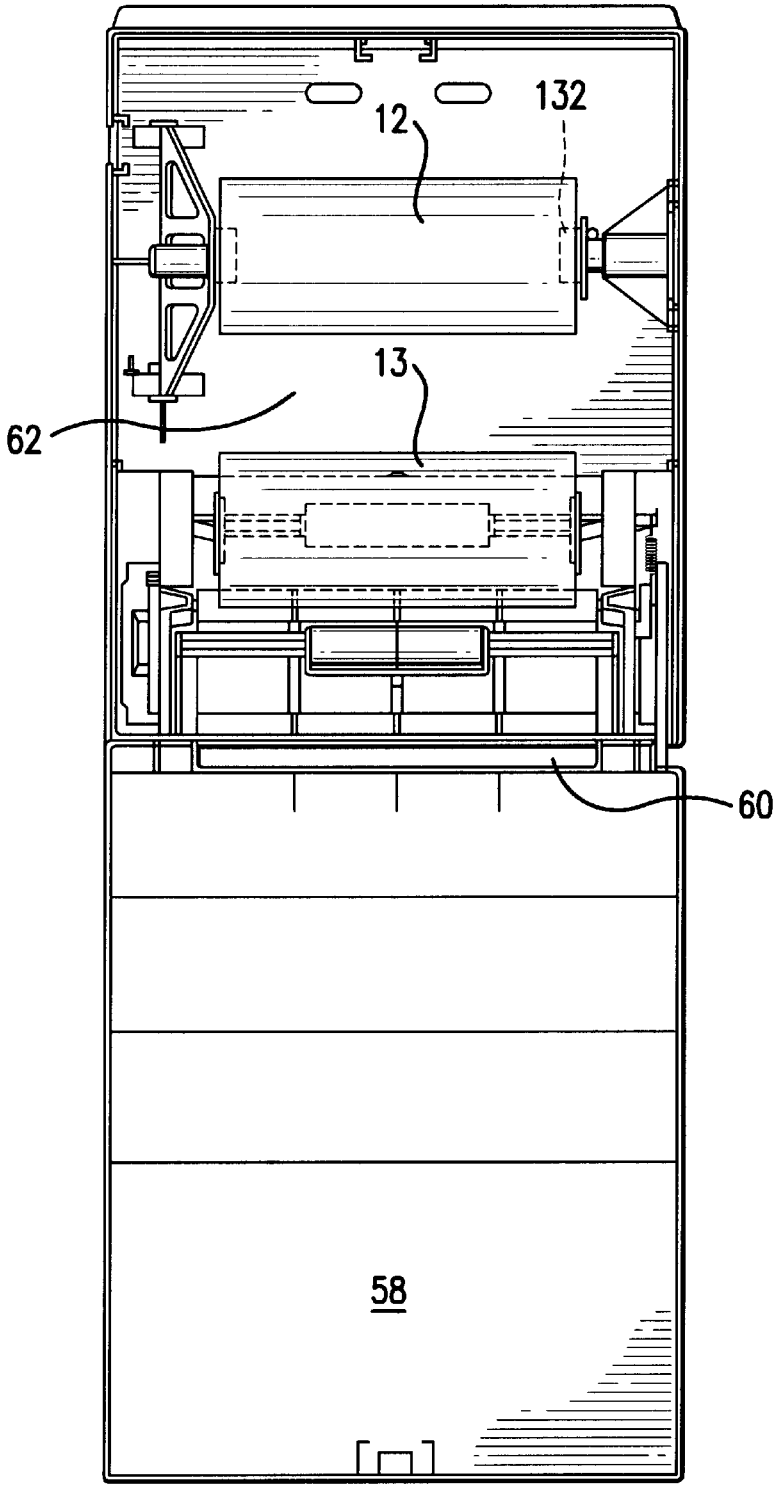
FIG.12 PRIOR ART
FIG. 12 is a front elevational view of an embodiment of the dispenser and cutting apparatus with the front housing in the open position.

FIG. 12 displays another embodiment of the dispenser 10. FIG. 12 is illustrative of one configuration between the front housing 58 and the rear housing 62. The front housing 58 is hingeably connected to the rear housing 62 and can be opened by a maintenance person to repair the dispenser 10 or add new rolls of towel 12. The dispensing slot 60 is located at approximately the bottom of the front housing 58 for a user to dispense towel therefrom. The components of the dispenser 10 as previously described in various embodiments may be inserted within the compartment that is formed by the rear housing 62 and the front housing 58. The components shown in FIG. 12 are illustrative of only another embodiment of the present invention, and may be substituted therewith.

It should be understood that the invention includes various modifications that can be made to the embodiments of the roll towel dispenser 10 described herein as come within the scope of the appended claims and their equivalents.

What is claim is:

1. A dispenser for delivering and severing sheets of web from a roll of the web material comprising:

a housing defining a compartment, said housing having a dispensing slot defined therein;

a roll holder located in said compartment for holding a roll of the web material;

a frame mounted within said compartment;

a drive roller rotatably supported in said frame, said drive roller having a slot therein, and said drive roller defining at least one annular groove therein;

a cutting blade support member rotatably supported on said frame substantially parallel to said drive roller, said cutting blade support member having a cutting blade extending therefrom;

a guide roller supported by said frame and urged toward said drive roller so as to form a nip with said drive roller, said drive roller being driven by the action of a user pulling on a tail of the web material passing through said nip and extending through said dispensing slot, said guide roller defining at least one annular groove therein;

said cutting blade geared to said drive roller such that rotation of said drive roller causes rotation of said cutting blade support member and insertion of said cutting blade into said slot to perforate the web allowing the user to separate a sheet of the web from the roll; and a plurality of stripper guides partially disposed within the annular grooves of the guide roller and the drive roller, the stripper guides prevent the sheets from wrapping around the guide roller and the drive roller during dispensing, wherein the guide is rotated relative to the stripper guides and the stripper guides are non-rotatable with respect to the frame.

2. The dispenser as set forth in claim 1, wherein said guide roller is urged toward said drive roller with at least one spring.

3. The dispenser as set forth in claim 1, wherein said roll holder is pivotable and biased with at least one spring.

4. The dispenser as set forth in claim 1, wherein at least part of the surface of the guide roller is of a higher friction material than the remaining surface of the guide roller.

5. The dispenser as set forth in claim 1, wherein at least part of the surface of said drive roller is of a higher friction material than the remaining surface of the drive roller.

6. The dispenser as set forth in claim 1, wherein the guide roller has at least one area of larger diameter near the middle of the guide roller for aiding in centering the sheet on the guide roller and drive roller.

7. The dispenser as set forth in claim 1, further comprising a rotary knob communicating with said drive roller.

8. The dispenser as set forth in claim 1, further comprising:

a push bar pivotable with respect to said frame, said push bar located proximate to the housing; and a rack and pinion arrangement communicating with the push bar and the drive roller.

9. The dispenser as set forth in claim 1, further comprising a spring-loaded mechanism to facilitate rotation of said cutting blade into said slot of said drive roller.

10. The dispenser as set forth in claim 1, wherein said cutting blade and said slot in said drive roller are chevron shaped.

11. The dispenser as set forth in claim 10, wherein said cutting blade includes a plurality of teeth having points at the distal end thereof and which perforate the web as said teeth center said slot in said drive roller.

12. The dispenser as set forth in claim 1, wherein said housing comprises a front member closable on a rear member, and said frame and said drive roller block access to said cutting blade when said front member is in an open position from said rear member.

13. The dispenser as set forth in claim 1, further comprising a first roll of towel and a second roll of towel carried by said housing.

14. The dispenser as set forth in claim 13, further comprising an automatic transfer system operative to feed a tail of said first roll to said drive roller when said second roll has been exhausted to a predetermined extent.

15. The dispenser as set forth in claim 14, wherein said automatic transfer system comprises:

a pair of first rocker arms pivotably mounted at opposite ends of said cutting blade support member, each of said rocker arms including a sensor support member and a gear member;

a sensor affixed to each of said sensor support members and spanning therebetween;

a pair of second rocker arms pivotably mounted to the frame at opposite sides thereof, each of said second rocker arms including a transfer rod support member and a geared surface, each of said geared surfaces meshing with one of said gear members;

a transfer rod affixed to each of said transfer rod support members and spanning therebetween;

wherein the tail of the second roll of towel is attached to said transfer rod; and wherein said sensor is biased against an outside surface of said first roll of towel such that as the first roll is depleted, said sensor remains in contact with the outside surface of said first roll of towel, the resulting rotational movement of said first pair of rocker arms driving rotation of said second pair of rocker arms through the interaction of said geared surfaces with said gear members thereby moving said transfer rod and the tail of the second roll of towel toward said nip, the tail of the second roll of towel being delivered to said nip when said first roll has exhausted to said predetermined extent.

16. The dispenser as set forth in claim 1, further comprising a brake mechanism operative to provide a positive stop to said drive roller when a predetermined length of web has been withdrawn by a user.

17. The dispenser as set forth in claim 16, wherein said braking mechanism comprises:

a jumping cam connected to said cutting blade support member, said jumping cam including one radial step;

a pair of brackets from said frame proximate to said cutting blade support member;

a shock absorbing member mounted between said brackets and adapted for intermittent, bi-directional rotational movement about an axis of said cutting blade support member, said shock absorbing member including a shaft therein;

a spring biasing said shock absorbing member to a normal position;

a slotted piston residing in said shaft;

a cam follower projecting from said piston, said cam follower interacting with said jumping cam when the cutting blade support member is rotated such that said piston is caused to reciprocate within said shaft;

a brake stop extending from said piston toward said spur gear; and a gear stop extending toward said piston, said piston moving to a position wherein said brake stop is rammed by said gear stop after a predetermined length of web has been extracted by a user thereby preventing the user from causing the web to free spool from the dispenser, said jumping cam then allowing the piston to fall within the shaft moving such that said brake stop no longer interferes with said gear stop allowing the user to extract another predetermined length of web.

18. A roll web guide system for defining a web travel path in a dispenser, the web guide system comprising:

a drive roller rotatably mounted within said dispenser, said drive roller defining at least one annular groove therein;

a guide roller urged toward said drive roller to form a nip with said drive roller, said guide roller defining at least one annular groove therein;

a plurality of stripper guides partially disposed within the annular grooves of the guide roller and drive roller, the stripper guides prevent the web from wrapping around the guide roller and the drive roller, wherein the guide roller is rotatable relative to the stripper guides and the stripper guides are non-rotatable with respect to the dispenser.

19. A dispenser for delivering and severing sheets of web from a roll of web material comprising:

a housing defining a compartment in which the roll is maintained;

a roll holder located in said housing for supporting the roll;

a frame attached to said housing;

a drive roller rotatably supported on said frame, said drive roller defining at least one annular groove therein;

a cutting blade support member rotatably supported on said frame substantially parallel to said drive roller, said cutting blade support member having a cutting blade extending therefrom;

a guide roller supported by said frame and urged by at least one spring toward said drive roller to form a nip with said drive roller, said drive roller being driven by the action of a user pulling on a tail of the roll, said guide roller defining at least one annular groove therein;

a plurality of stripper guides partially disposed within the annular grooves of the guide roller and the drive roller, the stripper guides prevent the sheets from wrapping around the guide roller and drive roller during dispensing, and also ensure the web remains proximate to the drive roller when the web is wound around the drive roller, wherein the guide roller is rotatable relative to the stripper guides and the stripper guides are non-rotatable with respect to the housing.

20. The dispenser as set forth in claim 19, wherein the roll holder is pivotable with respect to the frame.

21. The dispenser as set forth in claim 20, wherein the roll holder is biased with at least one spring.

22. The dispenser as set forth in claim 19, wherein at least part of the surface of the guide roller is of a higher friction material than the remaining surface of the guide roller.

23. The dispenser as set forth in claim 19, wherein at least part of the surface of the drive roller is of a higher friction material than the remaining surface of the drive roller.

24. The dispenser as set forth in claim 19, wherein the guide roller has at least one area of larger diameter near the middle of the guide roller for aiding in centering the sheet on the guide roller and drive roller.

25. The dispenser as set forth in claim 19, further comprising a rotary knob communicating with said drive roller.

26. The dispenser as set forth in claim 19, further comprising:

a push bar pivotable with respect to said frame, said push bar located proximate to said housing; and a rack and pinion arrangement communicating with the push bar and the driver roller.

* * * * *

UNITED STATES PATENT AND TRADEMARK OFFICE

CERTIFICATE OF CORRECTION

PATENT NO. : 6,684,751 B2 
DATED : February 3, 2004
INVENTOR(S) : David Wayne Kapiloff, Richard Paul Lewis and Paul Francis Tramontina It is certified that error appears in the above-identified patent and that said Letters Patent is hereby corrected as shown below:

Column 12,
Line 50, "guide is rotated" should read -- guide roller is rotatable --.

Signed and Sealed this

Fourteenth Day of September, 2004

JON W. DUDAS
*Director of the United States Patent and Trademark Office*